US010830158B2

(12) United States Patent
Iwata et al.

(10) Patent No.: US 10,830,158 B2
(45) Date of Patent: Nov. 10, 2020

(54) THROTTLE CONTROL METHOD, THROTTLE CONTROL DEVICE, AND THROTTLE CONTROL SYSTEM

(71) Applicant: SUZUKI MOTOR CORPORATION, Hamamatsu (JP)

(72) Inventors: Hideya Iwata, Hamamatsu (JP); Kenta Sugimoto, Hamamatsu (JP); Taiki Mase, Hamamatsu (JP)

(73) Assignee: SUZUKI MOTOR CORPORATION, Shizuoka (JP)

( * ) Notice: Subject to any disclaimer, the term of this patent is extended or adjusted under 35 U.S.C. 154(b) by 0 days.

(21) Appl. No.: 16/420,949

(22) Filed: May 23, 2019

(65) Prior Publication Data

US 2019/0368427 A1 Dec. 5, 2019

(30) Foreign Application Priority Data

Jun. 1, 2018 (JP) ..... 2018-105796

(51) Int. Cl.

| | |
|---|---|
| ***F02D 9/10*** | (2006.01) |
| ***F02D 9/02*** | (2006.01) |
| ***F02D 41/00*** | (2006.01) |
| ***F02D 41/04*** | (2006.01) |
| *F02D 41/18* | (2006.01) |

(52) U.S. Cl.

CPC ..... *F02D 9/109* (2013.01); *F02D 9/02* (2013.01); *F02D 41/008* (2013.01); *F02D 41/0085* (2013.01); *F02D 41/04* (2013.01); *F02D 41/18* (2013.01); *F02D 2009/022* (2013.01); *F02D 2009/023* (2013.01); *F02D 2009/0235* (2013.01)

(58) Field of Classification Search

CPC ..... F02D 9/02; F02D 9/109; F02D 2009/022; F02D 2009/023; F02D 2009/0235; F02D 41/04; F02D 41/18; F02D 41/0085; F02M 36/10065

USPC ..... 123/436, 336

See application file for complete search history.

(56) References Cited

U.S. PATENT DOCUMENTS

| | | | | |
|---|---|---|---|---|
| 4,264,535 | A * | 4/1981 | Kikura | F02M 13/02 123/184.39 |
| 2006/0042593 | A1* | 3/2006 | Nakamoto | F02D 9/109 123/399 |
| 2011/0048373 | A1 | 3/2011 | Okoshi et al. | 123/399 |
| 2019/0162109 | A1* | 5/2019 | Romana | F02B 29/0418 |

FOREIGN PATENT DOCUMENTS

| | | | |
|---|---|---|---|
| JP | 2009203829 | A * | 9/2009 |
| JP | 5184466 | B2 | 4/2013 |

* cited by examiner

*Primary Examiner* — Mahmoud Gimie
(74) *Attorney, Agent, or Firm* — Stein IP, LLC

(57) ABSTRACT

A throttle control method of controlling an opening degree of a throttle valve in a multi-cylinder engine that includes throttle valves in intake passages provided for each cylinder. It is possible to independently control the opening degree for each of the throttle valves. The throttle control method includes controlling the opening degree of the throttle valve is based on differences among intake air amounts in the respective intake passages.

6 Claims, 4 Drawing Sheets

THROTTLE CONTROL METHOD, THROTTLE CONTROL DEVICE, AND THROTTLE CONTROL SYSTEM

CROSS-REFERENCE TO RELATED APPLICATIONS

This application is based on Japanese Patent Application (No. 2018-105796) filed on Jun. 1, 2018, the contents of which are incorporated herein by way of reference.

BACKGROUND

The present invention relates to a throttle control method, a throttle control device, and a throttle control system.

In vehicle throttle control devices, there is a vehicle throttle control device that detects an operation amount of an accelerator and calculates an optimum opening degree of a throttle valve based on a detected accelerator opening degree and signals from various sensors (see, for example, JP-B-5184466). In JP-B-5184466, an electronic throttle control device is adopted in which a throttle valve is opened and closed by driving a motor based on a calculated target opening degree of the throttle valve.

Patent Document 1: JP-B-5184466

SUMMARY

A throttle control method according to an aspect of the present invention is a throttle control method for controlling an opening degree of a throttle valve in a multi-cylinder engine that includes throttle valves in intake passages provided for each cylinder. It is possible to independently control the opening degree for each of the throttle valves. The throttle control method includes controlling the opening degree of the throttle valve based on differences among intake air amounts in the respective intake passages.

A throttle control device according to an aspect of the present invention is a throttle control device for controlling an opening degree of a throttle valve in a multi-cylinder engine that includes throttle valves in intake passages provided for each cylinder. The throttle control device is configured to independently control the opening degree for each of the throttle valves. A control of the opening degree of the throttle valve is performed based on differences among intake air amounts in the respective intake passages.

A throttle control system according to an aspect of the present invention includes an intake passage that is provided for each cylinder of a multi-cylinder engine, a throttle valve that is provided in each intake passage, and a control device that is configured to independently control an opening degree of each throttle valve. The control device is configured to control the opening degree of the throttle valve based on differences among intake air amounts in the respective intake passages.

DETAILED DESCRIPTION OF EXEMPLIFIED EMBODIMENTS

In a multi-cylinder engine, when a throttle valve is provided for each cylinder (intake passage), it is necessary to adjust differences in intake air amount among the intake passages. This adjustment operation is manually performed by a person skilled in the art, and an advanced technique is required. Therefore, there is a demand for a throttle control method that is capable of constantly maintaining an optimum intake air amount without requiring a large-scale adjustment operation.

The present invention is made in view of the above points. It is an object of the present invention to provide a throttle control method, a throttle control device, and a throttle control system that is capable of reducing differences in the intake air amount among a plurality of cylinders without requiring a complicated adjustment operation.

Hereinafter, embodiments of the present invention are described in detail with reference to the accompanying drawings. Hereinafter, a motorcycle is described as an example of a vehicle to which the present invention is applied. However, an application target can be changed without being limited thereto. For example, the present invention may be applied to other types of vehicles such as a four-wheeled vehicle.

Figure 1:
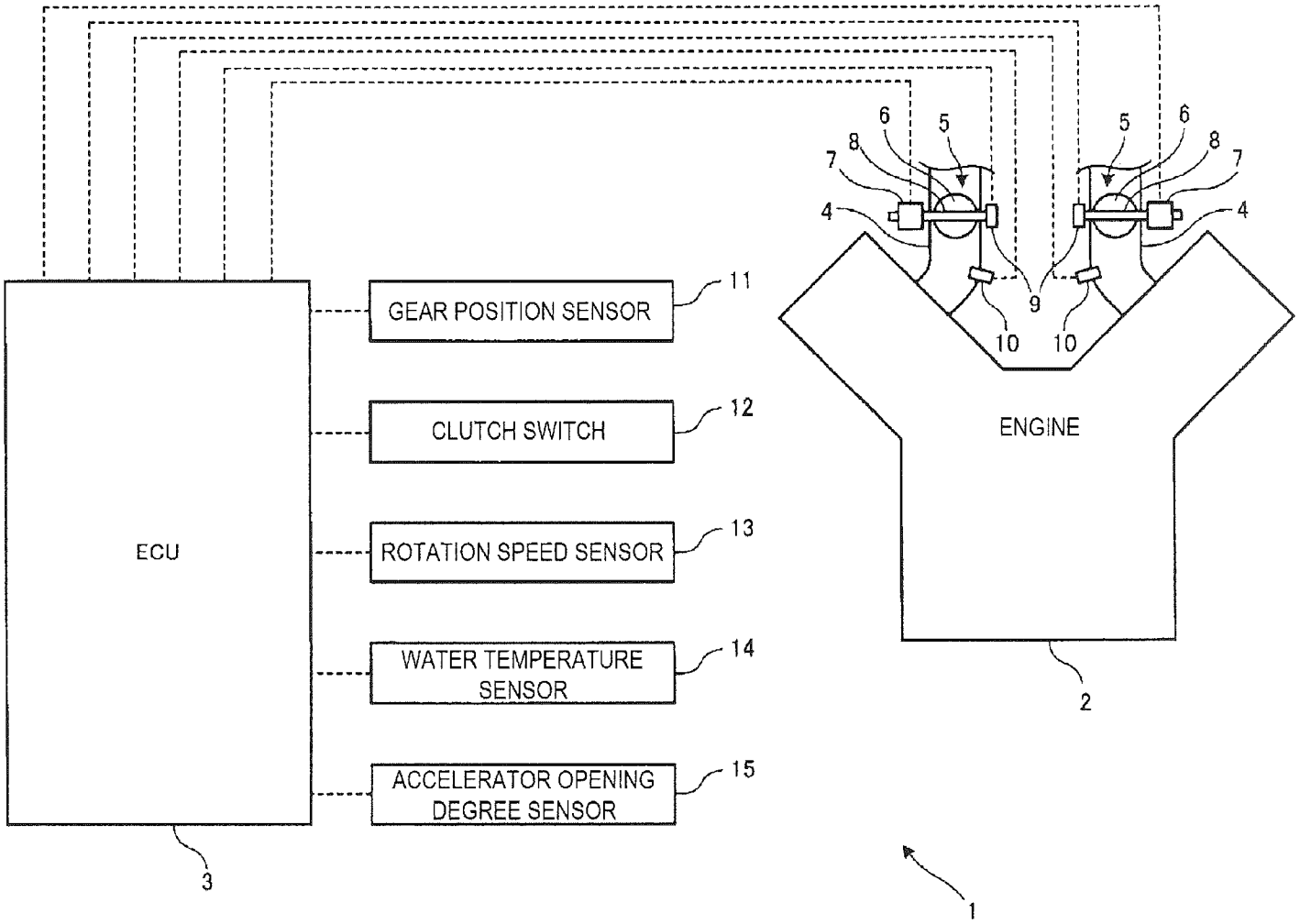
FIG. 1 is an overall configuration diagram of a throttle control system according to the present embodiment.

A throttle control system according to the present embodiment is described with reference to FIG. 1. FIG. 1 is an overall configuration diagram of the throttle control system according to the present embodiment. The throttle control system is not limited to a configuration described below, and can be changed appropriately.

As illustrated in FIG. 1, a throttle control system 1 is configured to control operation of an engine 2 as an internal combustion engine and an operation of a peripheral structure of the engine 2 with an Electronic Control Unit (ECU) 3. As described in detail below, the ECU 3 constitutes a throttle control device according to the present application. The engine 2 is a multi-cylinder engine, and is, for example, a so-called V-type two-cylinder engine in which a plurality of (two in FIG. 1) cylinders are provided so as to form a predetermined angle in a front-rear direction.

An intake pipe 4 is connected respectively to an intake port (not illustrated) formed in each cylinder of the engine 2. The intake pipe 4 forms an intake passage that is configured to introduce intake air into the cylinder. A throttle body 5 is provided in each intake passage.

The throttle body 5 is configured by a so-called electronically controlled throttle that opens and closes throttle valves 6 by an actuator 7 in response to an accelerator operation by an occupant or control by the ECU 3. Specifically, the throttle body 5 adjusts an opening degree of a circular valve body (throttle valve 6) by rotationally driving the circular valve body (throttle valve 6) around a predetermined rotation shaft 8. Thus, a cross-sectional area of the intake passage is enlarged or reduced, so that it is possible to adjust a flow rate and a flow velocity of the intake air flowing through the intake passage.

The rotation shaft 8 extends in a direction intersecting a axial direction of the intake passage so as to include a center of the throttle valve 6, and is integrally fixed to the throttle valve 6. The actuator 7 that is configured to rotationally drive the throttle valve 6 is provided at one end portion of the rotation shaft 8. The actuator 7 is configured by, for example, an electric motor, and is configured to rotationally drive the throttle valve 6 in response to a command from the ECU 3.

A throttle opening degree sensor 9 is provided on another end side of the rotation shaft 8. The throttle opening degree sensor 9 is configured to detect an opening degree of the throttle valve 6, and to output a detected value of the opening degree of the throttle valve 6 to the ECU 3. An intake air amount sensor 10 is provided between the intake port and the throttle body 5, that is, in the intake passage on downstream side of the throttle body 5. The intake air amount sensor 10 is configured to detect an intake air amount (mass flow rate) of intake air that flows through the intake passage after passing through the throttle body 5, and to output a detected value of the intake air amount (mass flow rate) to the ECU 3. Instead of the intake air amount sensor 10, an intake pressure sensor that is configured to detect an intake pressure may be provided.

The throttle control system 1 includes a gear position sensor 11, a clutch switch 12, a rotation speed sensor 13, a water temperature sensor 14, an accelerator opening degree sensor 15, and the like. These various sensors and the like are provided at appropriate positions in the vehicle, and are configured to output predetermined electric signals to the ECU 3.

Specifically, the gear position sensor 11 is provided in a transmission (not illustrated), and is configured to detect a gear position of the transmission and to output a detected value of the gear position of the transmission to the ECU 3. The clutch switch 12 is provided, for example, on a handle bar (not illustrated), and is configured to output an electric signal relating to engagement and disengagement (ON and OFF) of a clutch to the ECU 3. The rotation speed sensor 13 is configured to detect an engine rotation speed and to output a detected value of the engine rotation speed to the ECU 3. The water temperature sensor 14 is configured to detect an engine water temperature and to output a detected value of the engine water temperature to the ECU 3. The accelerator opening degree sensor 15 is provided, for example, on the handle bar, and is configured to detect an accelerator opening degree and to output a detected value of the accelerator opening degree to the ECU 3.

The ECU 3 is configured to integrally control an operation of the entire vehicle including various structures inside and outside of the engine 2. The ECU 3 includes a processor, a memory, and the like that are configured to execute various processes. The memory is configured by a storage medium such as a Read Only Memory (ROM) and a Random Access Memory (RAM), depending on an application. The memory stores, for example, a control program that is configured to control the above-described various structures.

The ECU 3 is configured to determine a state of the vehicle from the various sensors provided in the vehicle, and to control driving of the throttle body 5 (actuator 7) and the like. As described in detail below, the ECU 3 can independently control an opening degree of the throttle valve 6 provided for each cylinder. Further, the ECU 3 is configured to control an opening degree of each throttle valve 6 based on a difference between intake air amounts in the intake passages.

For example, the ECU 3 is configured to calculate an opening and closing amount of the throttle valve 6 based on an accelerator opening degree (accelerator operation amount) acquired from the accelerator opening degree sensor 15. In addition, the ECU 3 is configured to control an opening degree of the throttle valve 6 based on an intake air amount acquired from each intake air amount sensor 10 provided for each intake passage and an engine rotation speed acquired from the rotation speed sensor 13 under a predetermined condition. Here, the predetermined condition means a so-called idle state in which there is no accelerator operation by the occupant.

Under the predetermined condition, the ECU 3 is configured to compare the intake air amounts of the respective intake passages, and, when there is a difference between the respective intake air amounts, to perform an independent opening and closing control for each throttle valve 6 such that the difference between the respective intake air amounts becomes small. As an example of the opening and closing control, a control is performed so as to open the throttle valve 6 in the intake passage with a relatively small intake air amount, or a control is performed so as to close the throttle valve 6 in the intake passage with a relatively large intake air amount.

Meanwhile, in vehicle throttle control devices, there is a vehicle throttle control device that detects an operation amount of an accelerator and calculates an optimum opening degree of a throttle valve based on a detected accelerator opening degree and signals from various sensors. As a control device of this type, an electronic throttle control device is adopted in which a throttle valve is opened and closed by driving a motor based on a calculated target opening degree of the throttle valve.

However, when the above-described electronic throttle device is applied to a multi-cylinder engine including a throttle valve for each cylinder, various problems may occur. Specifically, in the multi-cylinder engine, when a throttle valve is provided for each cylinder (intake passage), it is necessary to adjust differences in the intake air amount among the intake passages.

More specifically, a bypass passage that communicates an upstream side of the throttle valve and an downstream side of the throttle valve so as to bypass the throttle valve may be provided in the intake passage, and an intake air amount adjustment valve may be provided in an intermediate part of the bypass passage. These are provided in the multi-cylinder engine including the throttle valve for each cylinder since differences occur in the intake air amount for each cylinder due to variations in dimension among cylinders and aging. In a related art, it is known to reduce the differences in the intake air amount among the cylinders by adjusting an intake air amount adjustment valve provided in the bypass passage.

However, the adjustment operation needs to be performed periodically since the intake air amount changes over time due to carbon fouling and the like caused by blow-back from a fuel chamber. In addition, this adjustment work is manually performed by a person skilled in the art, and an advanced technique is required. Therefore, there is a demand for a throttle control method that is capable of constantly maintaining an optimum intake air amount without requiring a large-scale adjustment operation.

Therefore, the present inventors focused on the intake air amount in the intake passage provided for each cylinder in the multi-cylinder engine, and conceived the present invention. Specifically, in the present embodiment, the ECU 3 is capable of independently controlling an opening degree for each throttle valve 6 provided in each intake passage, and is configured to compare the intake air amounts in the respective intake passages and to control the opening degree of each throttle valve 6 based on differences among the intake air amounts.

According to this configuration, it is possible to adjust such that the differences in the intake air amount between the cylinders become small by independently controlling opening degrees of the plurality of throttle valves 6. Therefore, the intake air amounts between the cylinders are automatically equalized, so that the bypass passage and the intake air amount adjustment valve as described above become unnecessary. Therefore, it is possible to maintain an optimum intake air amount constantly by reducing differences in the intake air amount among the plurality of cylinders without requiring a complicated adjustment operation.

Figure 2:
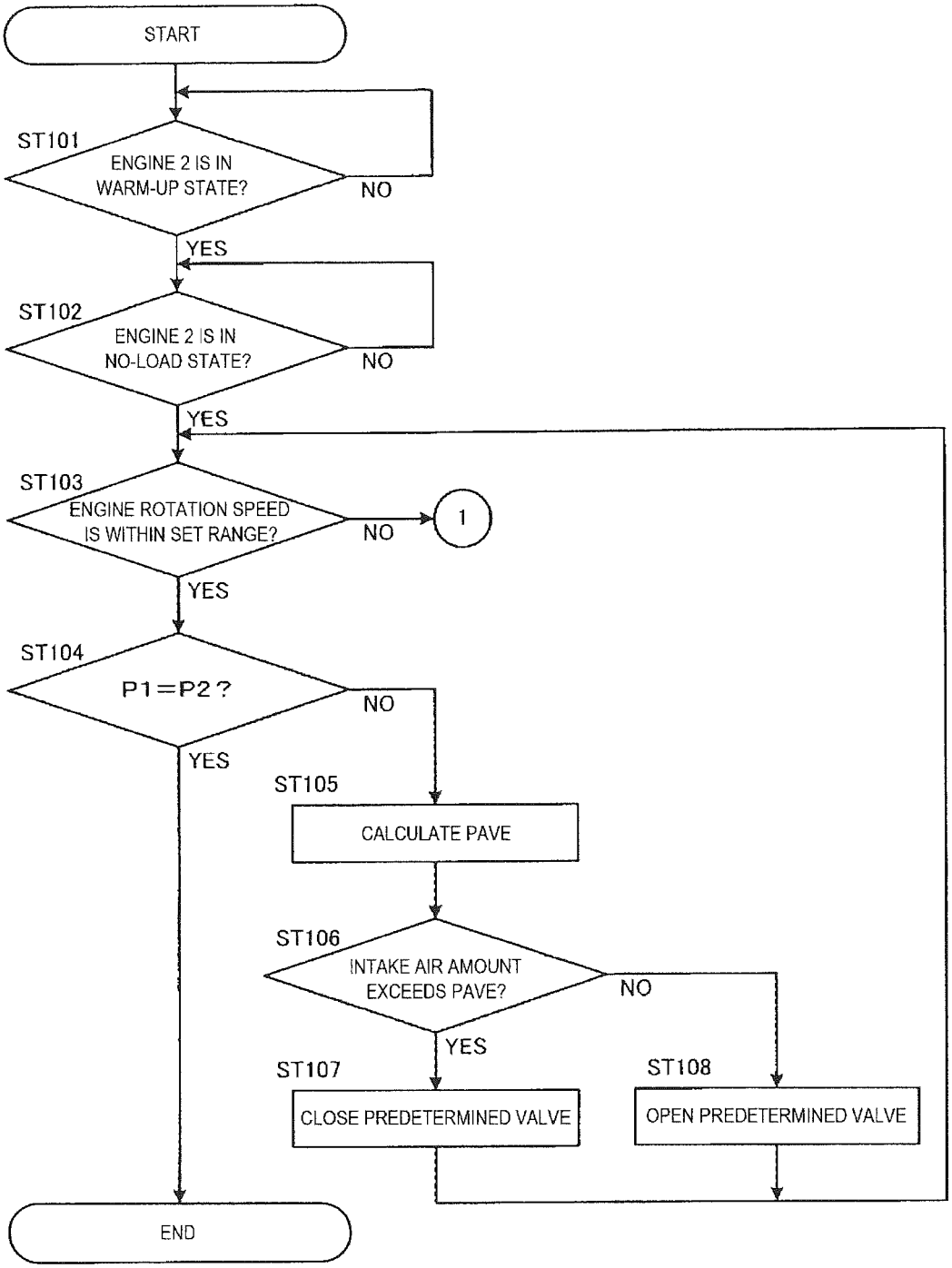
FIG. 2 is a diagram showing an example of a throttle control flow according to the present embodiment.
Figure 3:
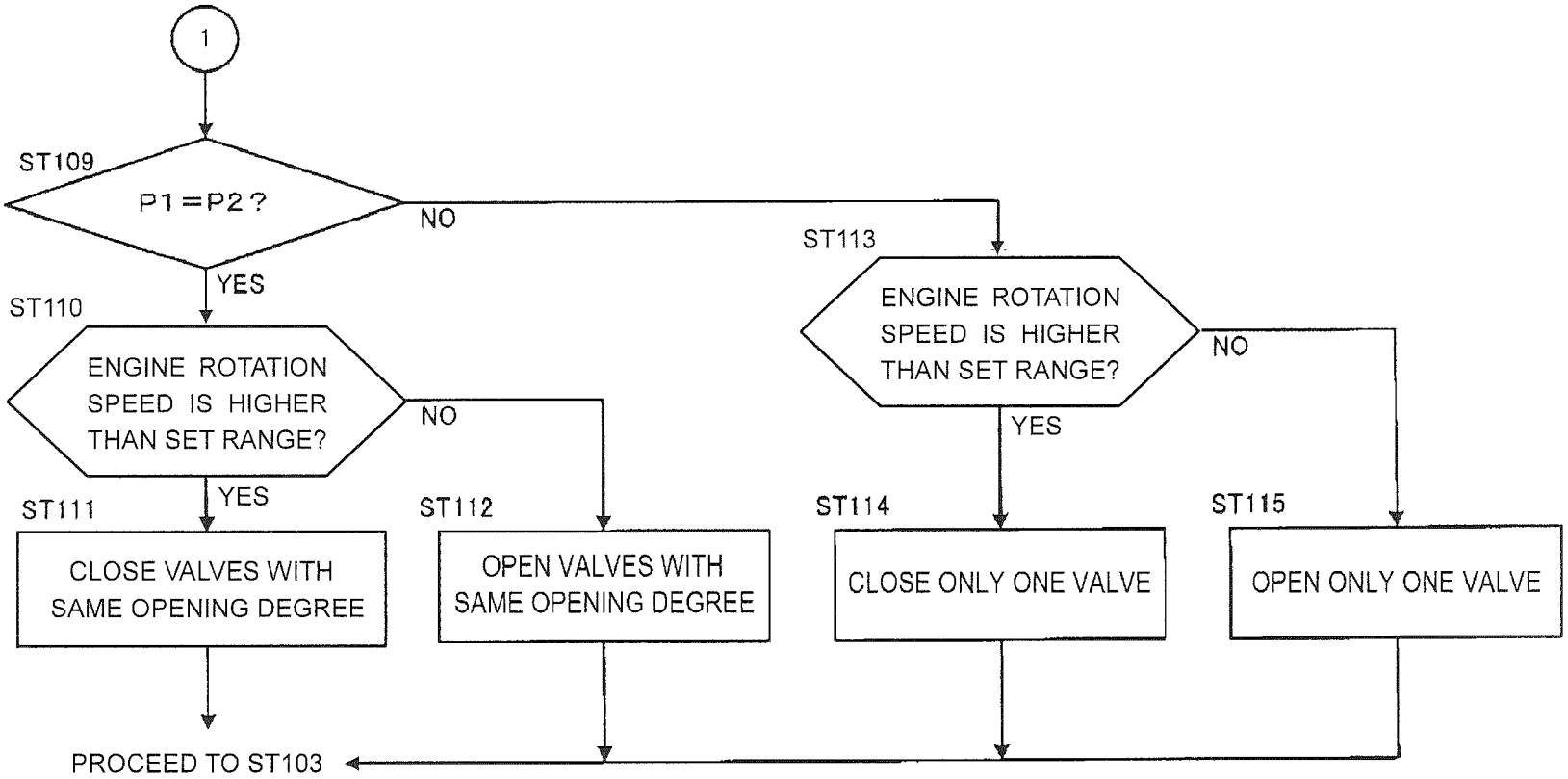
FIG. 3 is a diagram showing an example of a throttle control flow according to the present embodiment.

Next, a throttle control method (throttle control flow) according to the present embodiment is described with reference to FIGS. 2 and 3. FIGS. 2 and 3 are diagrams showing an example of the throttle control flow according to the present embodiment. In the throttle control flow described below, unless otherwise specified, a subject of an operation (calculation, determination, and the like) is referred to as the ECU.

As shown in FIG. 2, when the throttle control flow is started, in step ST 101, the ECU 3 determines whether the engine 2 is in a warm-up state. The ECU 3 determines the warm-up state of the engine 2 based on, for example, whether an engine water temperature obtained from the water temperature sensor 14 is equal to or higher than a predetermined temperature. When the engine 2 is in the warm-up state (step ST101: YES), a process proceeds to step ST102. When the engine 2 is not in the warm-up state (step ST101: NO), the process of step ST101 is repeated.

In step ST102, the ECU 3 determines whether the engine 2 is in a no-load state. The ECU 3 determines a load state of the engine 2 based on the detected values of the throttle opening degree sensor 9, the gear position sensor 11, the clutch switch 12, the accelerator opening degree sensor 15, and the like. For example, the ECU 3 can determine that the engine 2 is in the no-load state when an accelerator is in an OFF state and a gear position is in a neutral or clutch off state. When the engine 2 is in the no-load state (step ST102: YES), the process proceeds to step ST103. When the engine 2 is not in the no-load state (step ST102: NO), the process of step ST102 is repeated.

In step ST103, the ECU 3 determines whether an engine rotation speed is within a set range based on the detected value of the rotation speed sensor 13. Here, the set range is a predetermined range of an idle rotation speed. When the engine rotation speed is within the set range (step ST103: YES), the process proceeds to step ST104. When the engine rotation speed is not within the set range (step ST103: NO), the process proceeds to step ST109 in FIG. 3.

In step ST104, the ECU 3 acquires the intake air amount in each intake passage from the detected value of the intake air amount sensor 10 (or intake pressure sensor), and determines whether an intake air amount P1 in one intake passage is equal to an intake air amount P2 in another intake passage. When P1=P2 is satisfied (step ST104: YES), the ECU 3 determines that there is no difference in the intake air amount between the respective intake passages, so that a control ends. When P1=P2 is not satisfied (step ST104: NO), the ECU 3 determines that there is a difference in the intake air amount between the respective intake passages, so that the process proceeds to step ST105.

In step ST105, the ECU 3 calculates an average intake air amount Pave which is an average value of the two intake air amounts P1, P2. Then, the process proceeds to step ST106.

In step ST106, the ECU 3 compares a calculated average intake air amount Pave with the two intake air amounts P1, P2, and determines whether each intake air amount exceeds the average intake air amount Pave. When each intake air amount exceeds the average intake air amount Pave (step ST106: YES), the process proceeds to step ST107. When each intake air amount does not exceed (falls below) the average intake air amount Pave (step ST106: NO), the process proceeds to step ST108.

In step ST107, the ECU 3 controls the opening degree of the throttle valve 6 in a predetermined intake passage, which is an object exceeding the average intake air amount Pave, toward a closing direction. As a result, it is possible to bring the intake air amount in the intake passage close to the average intake air amount Pave. Then, the process returns to step ST103.

In step ST108, the ECU 3 controls the opening degree of the throttle valve 6 in a predetermined intake passage, which is an object falling below the average intake air amount Pave, toward an opening direction. As a result, it is possible to bring the intake air amount in the intake passage close to the average intake air amount Pave. Then, the process returns to step ST103.

When the engine rotation speed is not within the set range in step ST103, as shown in FIG. 3, in subsequent step ST109, the ECU 3 acquires the intake air amount in each intake passage from the detected value of the intake air amount sensor 10 (or intake pressure sensor), and determines whether the intake air amount P1 in the one intake passage is equal to the intake air amount P2 in the other intake passage. When P1=P2 is satisfied (step ST109: YES), the ECU 3 determines that there is no difference in the intake air amount between the respective intake passages, so that the process proceeds to step ST110. When P1=P2 is not satisfied (step ST109: NO), the ECU 3 determines that there is a difference in the intake air amount between the respective intake passages, so that the process proceeds to step ST113.

In step ST110, the ECU 3 determines whether the engine rotation speed is higher than the set range based on the detected value of the rotation speed sensor 13. When the engine rotation speed is higher than the set range (step ST110: YES), the process proceeds to step ST111. When the engine rotation speed is not higher than the set range, that is, when the engine rotation speed is lower than the set range (step ST110: NO), the process proceeds to step ST112.

In step ST111, the ECU 3 controls the two throttle valves 6 toward the closing direction with the same opening degree such that the engine rotation speed falls within (below) the set range. In this case, the intake air amounts are equal, so that it is not necessary to separately control the respective throttle valves 6, and it is possible to control the respective throttle valves 6 with a common opening degree. Then, the process returns to step ST103.

In step ST112, the ECU 3 controls the two throttle valves 6 toward the opening direction with the same opening degree such that the engine rotation speed falls within (above) the set range. Also in this case, the intake air amounts are equal, so that it is not necessary to separately control the respective throttle valves 6, and it is possible to control the respective throttle valves 6 with a common opening degree. Then, the process returns to step ST103.

When P1=P2 is not satisfied in step ST 109, in subsequent step ST113, the ECU 3 determines whether the engine rotation speed is higher than the set range based on the detected value of the rotation speed sensor 13. When the engine rotation speed is higher than the set range (step ST113: YES), the process proceeds to step ST114. When the engine rotation speed is not higher than the set range, that is, when the engine rotation speed is lower than the set range (step ST113: NO), the process proceeds to step ST115.

In step ST114, the ECU 3 compares the two intake air amounts P1, P2, and controls the throttle valve 6 in an intake passage having a larger intake air amount toward the closing direction. As a result, it is possible to reduce the difference in the intake air amount between the intake passages, and to lower the engine rotation speed so as to fall (converge) within the set range. Then, the process returns to step ST103.

In step ST115, the ECU 3 compares the two intake air amounts P1, P2, and controls the throttle valve 6 in an intake passage having a smaller intake air amount toward the opening direction. As a result, it is possible to reduce the difference in the intake air amount between the intake passages, and to increase the engine rotation speed so as to fall (converge) within the set range. Then, the process returns to step ST103.

In this manner, in the throttle control flow shown in FIGS. 2 and 3, the ECU 3 calculates the average intake air amount of the throttle valve 6, and controls the opening degree of the throttle valve 6 in the predetermined intake passage based on a difference between the intake air amount in the predetermined intake passage and the average intake air amount. According to this configuration, the larger intake air amount and the smaller intake air amount are adjusted at the same time by controlling each throttle valve 6 based on the average intake air amount, so that it is possible to more efficiently perform a tuning adjustment of the throttle opening degree (adjustment to eliminate the difference in the intake air amount between the cylinders).

Further, the ECU 3 is configured to control an opening degree of another throttle valve 6 to be an opening degree of a throttle valve 6 in an intake passage having a largest intake air amount among a plurality of intake passages, and to control an opening degree of the other throttle valve 6 to be an opening degree of a throttle valve 6 in an intake passage having a smallest intake air amount among the plurality of intake passages. According to this configuration, it is also possible to perform an adjustment of increasing and decreasing the engine rotation speed in parallel with the tuning adjustment of the throttle opening degree by controlling a predetermined throttle valve 6 based on the largest intake air amount or the smallest intake air amount.

When the engine rotation speed is higher than the set range, the ECU 3 is configured to control so as to decrease the opening degree of the throttle valve 6 in the intake passage having the largest intake air amount among the plurality of intake passages. When the engine rotation speed is lower than the set range, the ECU 3 is configured to control so as to increase the opening degree of the throttle valve 6 in the intake passage having the smallest intake air amount among the plurality of intake passages. When the engine rotation speed deviates from the set range, the ECU 3 is configured to control so as to close or open all the throttle valves 6 at the same time. According to this configuration, it is possible to perform throttle opening degree control (which may be referred to as recovery control) so as to return the engine rotation speed within the set range when the engine rotation speed deviates from the set range while performing an opening and closing adjustment of the throttle valve 6. As a result, it is possible to converge the engine rotation speed within the set range at an appropriate time, and to drive the engine 2 more stably and efficiently. The control of converging the engine rotation speed within the set range may be referred to as an idle rotation speed feedback control.

When performing the recovery control, if the engine rotation speed is higher than the set range, the ECU 3 may control so as to close only the throttle valve in the intake passage having the largest intake air amount among the plurality of intake passages, and if the engine rotation speed is lower than the set range, the ECU 3 may control so as to open only the throttle valve in the intake passage having the smallest intake air amount among the plurality of intake passages. According to this configuration, it is possible to reduce the difference in the intake air amount while converging the engine speed within the set range, and to perform the tuning adjustment more efficiently, by controlling only the throttle valve 6 that needs to be adjusted.

As described above, according to the present embodiment, it is possible to reduce the differences in the intake air amount among the plurality of cylinders without requiring a complicated adjustment operation by comparing the intake air amounts in the respective intake passages and controlling the opening degree of each throttle valve 6 based on the differences of the intake air amounts in the respective intake passages.

Figure 4:
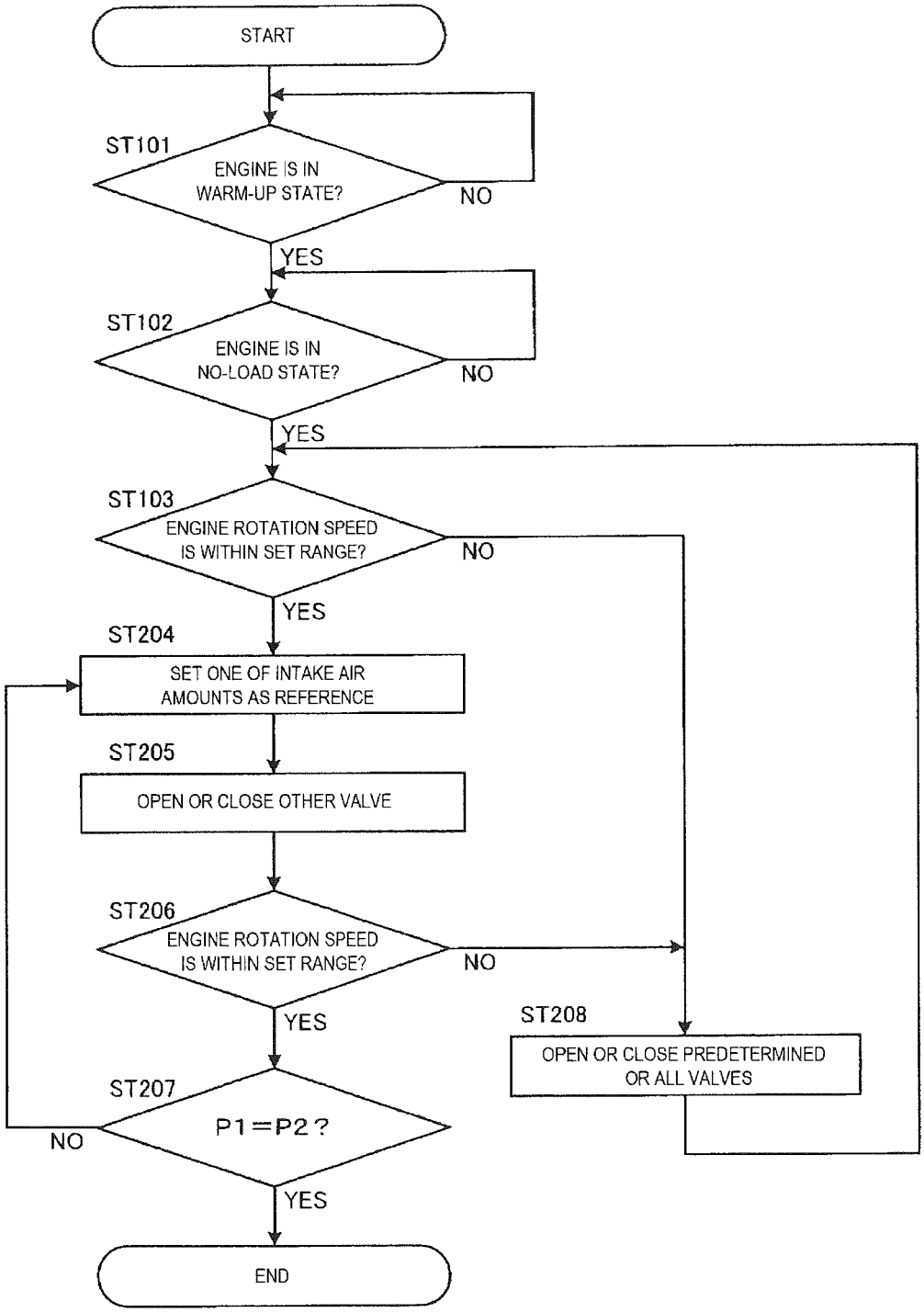
FIG. 4 is a diagram showing a throttle control flow according to a modification.

In the above embodiment, a case where the opening degree of the throttle valve 6 is controlled based on the average intake air amount is described. However, the present invention is not limited thereto. For example, a modification described below is also possible. Here, a throttle control method according to the modification is described with reference to FIG. 4. FIG. 4 is a diagram showing a throttle control flow according to the modification. In the modification, since the processing up to step ST103 is the same as that in FIG. 2, a description of the processing up to step ST103 is omitted, and subsequent steps are mainly described.

As shown in FIG. 4, in step ST103, when the engine rotation speed is within the set range (step ST103: YES), the process proceeds to step ST204. When the engine rotation speed is not within the set range (step ST103: NO), the process proceeds to step ST207.

In step ST204, the ECU 3 acquires the intake air amounts P1, P2 in the respective intake passages from the detected value of the intake air amount sensor 10 (or intake pressure sensor), and sets any one of the intake air amounts P1, P2 as a reference. Examples of the reference setting include the largest intake air amount and the smallest intake air amount. Then, the process proceeds to step ST205.

In step ST205, the ECU 3 controls the throttle valve 6 in one intake passage toward the opening direction or the closing direction such that one intake air amount approaches another intake air amount as the reference. Then, the process proceeds to step ST206.

In step ST206, the ECU 3 determines whether an engine rotation speed is within the set range based on the detected value of the rotation speed sensor 13. When the engine rotation speed is within the set range (step ST206: YES), the process proceeds to step ST207. When the engine rotation speed is not within the set range (step ST206: NO), the process proceeds to step ST208.

In step ST207, the ECU 3 determines whether the intake air amount P1 in one intake passage is equal to the intake air amount P2 in another intake passage. When P1=P2 is satisfied (step ST207: YES), the ECU 3 determines that there is no difference in the intake air amount between the respective intake passages, so that the control ends. When P1=P2 is not satisfied (step ST207: NO), the ECU 3 determines that there is a difference in the intake air amount between the respective intake passages, so that the process returns to step ST204.

In step ST208, the ECU 3 controls the predetermined throttle valve 6 or all the throttle valves 6 toward the opening direction or the closing direction such that the engine rotation speed converges within the set range. For example, it is conceivable to close all the throttle valves 6 with a same opening degree as the opening and closing control of the throttle valves 6 when the engine rotation speed is higher than the set range. In addition, when all the throttle valves 6 are closed, it is possible to control only the throttle valve 6 in the intake passage having the largest intake air amount to have a lower opening degree than that of other throttle valves 6. In addition, it is also possible to largely close only the throttle valve 6 in the intake passage having the largest intake air amount or to close all the throttle valves 6 other than the throttle valve 6 in the intake passage having the smallest intake air amount.

Meanwhile, it is conceivable to open all the throttle valves 6 with a same opening degree as the opening and closing control of the throttle valves 6 when the engine rotation speed is lower than the set range. In addition, when all the throttle valves 6 are opened, it is possible to control only the throttle valve 6 in the intake passage having the smallest intake air amount to have a higher opening degree than that of the other throttle valves 6. In addition, it is also possible to largely open only the throttle valve 6 in the intake passage having the smallest intake air amount or to open all the throttle valves 6 other than the throttle valve 6 in the intake passage having the largest intake air amount.

As described above, in the modification, it is also possible to achieve both the tuning adjustment of the intake air amount and the idle rotation speed feedback control.

In the above embodiments, a case where the opening degree of the throttle valve 6 is controlled based on the intake air amount is described. However, the present invention is not limited to this configuration. An intake pressure may be used instead of the intake air amount.

In the above embodiments, the V-type two-cylinder engine is described as an example. However, the present invention is not limited to this configuration. As long as the engine 2 is a multi-cylinder engine, the number and an arrangement of cylinders can be appropriately changed.

Although the present embodiment and the modification is described, the present embodiment and the modification may be combined in whole or in part as another embodiment of the present invention.

Embodiments of the present invention are not limited to the above embodiments, and various changes, substitutions and modifications may be made without departing from the spirit of the technical concept of the present invention. Further, the present invention may be implemented by use of other methods as long as the technical concept of the present invention can be implemented by the methods through advance of technology or other derivative technology. Accordingly, the appended claims cover all embodiments that may be included within the scope of the technical concept of the present invention.

As described above, the present invention has an effect that it is possible to reduce differences in the intake air amount among the plurality of cylinders without requiring a complicated adjustment operation, and is particularly useful for a throttle control method, a throttle control device, and a throttle control system that are adopted in a multi-cylinder engine.

What is claimed is:

1. A throttle control method for controlling an opening degree of a throttle valve in a multi-cylinder engine that includes throttle valves in intake passages provided for each cylinder, wherein it is possible to independently control the opening degree for each of the throttle valves, the throttle control method comprising:

controlling the opening degree of the throttle valve based on differences among intake air amounts in the respective intake passages;

calculating an average intake air amount of the throttle valves; and controlling an opening degree of a throttle valve in a predetermined intake passage based on a difference between an intake air amount in the predetermined intake passage and the average intake air amount.

2. A throttle control method for controlling an opening degree of a throttle valve in a multi-cylinder engine that includes throttle valves in intake passages provided for each cylinder, wherein it is possible to independently control the opening degree for each of the throttle valves, the throttle control method comprising:

controlling the opening degree of the throttle valve based on differences among intake air amounts in the respective intake passages, wherein an opening degree of another throttle valve is controlled to be an opening degree of a throttle valve in an intake passage having the largest intake air amount among a plurality of intake passages.

3. A throttle control method for controlling an opening degree of a throttle valve in a multi-cylinder engine that includes throttle valves in intake passages provided for each cylinder, wherein it is possible to independently control the opening degree for each of the throttle valves, the throttle control method comprising:

controlling the opening degree of the throttle valve based on differences among intake air amounts in the respective intake passages, wherein an opening degree of another throttle valve is controlled to be an opening degree of a throttle valve in an intake passage having the smallest intake air amount among a plurality of intake passages.

4. A throttle control method for controlling an opening degree of a throttle valve in a multi-cylinder engine that includes throttle valves in intake passages provided for each cylinder, wherein it is possible to independently control the opening degree for each of the throttle valves, the throttle control method comprising:

controlling the opening degree of the throttle valve based on differences among intake air amounts in the respective intake passages, wherein when an engine rotation speed is higher than a set range, the opening degree of the throttle valve in the intake passage having the largest intake air amount among the plurality of intake passages is controlled to be decreased, and when the engine rotation speed is lower than the set range, the opening degree of the throttle valve in the intake passage having the smallest intake air amount among the plurality of intake passages is controlled to be increased.

5. The throttle control method according to claim 4, wherein when the engine rotation speed deviates from the set range, all throttle valves are controlled to be opened or closed at the same time.

6. The throttle control method according to claim 4, wherein when the engine rotation speed is higher than the set range, only the throttle valve in the intake passage having the largest intake air amount among the plurality of intake passages is controlled to be closed, and when the engine rotation speed is lower than the set range, only the throttle valve in the intake passage having the smallest intake air amount among the plurality of intake passages is controlled to be opened.

* * * * *